United States Patent [19]

Shaffer

[11] 4,059,388

[45] Nov. 22, 1977

[54] PHOTOFLASH LAMP

[75] Inventor: John W. Shaffer, Willamsport, Pa.

[73] Assignee: GTE Sylvania Incorporated, Stamford, Conn.

[21] Appl. No.: 673,569

[22] Filed: Apr. 5, 1976

Related U.S. Application Data

[63] Continuation-in-part of Ser. No. 629,159, Nov. 5, 1975, abandoned.

[51] Int. Cl.[2] ..... F21K 5/02

[52] U.S. Cl. ..... 431/95 R

[58] Field of Search ..... 431/95

[56] References Cited

U.S. PATENT DOCUMENTS

| | | | |
|---|---|---|---|
| 2,305,561 | 12/1942 | Sylvester | 431/95 |
| 2,315,099 | 3/1943 | Van Liempt | 431/95 |
| 3,312,085 | 4/1967 | Schilling et al. | 431/95 |
| 3,823,994 | 7/1974 | De Graaf et al. | 431/95 |
| 3,873,260 | 3/1975 | Cote | 431/95 |
| 3,972,673 | 8/1976 | Schupp | 431/95 |

*Primary Examiner*—Carroll B. Dority, Jr.
*Attorney, Agent, or Firm*—Edward J. Coleman

[57] ABSTRACT

A high-voltage type photoflash lamp having an ignition structure comprising a mass of primer material bridging a pair of lead-in wires, one of which is enclosed in an insulating sleeve. The lamp contains a quantity of shredded metallic combustible and an amount of oxygen in excess of that needed to completely burn the combustible so as to burn back the unsleeved lead-in wire during flashing. The primer material comprises a mixture of combustible metal powder, one or more metal oxides and a binding agent and is free of oxidizer salts.

12 Claims, 2 Drawing Figures

PHOTOFLASH LAMP

CROSS-REFERENCE TO RELATED APPLICATION

This is a continuation-in-part of application Ser. No. 629,159, filed Nov. 5, 1975, now abandoned.

BACKGROUND OF THE INVENTION

This invention relates to photoflash lamps and, more particularly, to flashlamps of the type containing a primer arrangement ignited by a high voltage pulse.

High voltage flashlamps may be divided historically into four categories: (1) those having a spark gap within the lamp such that electrical breakdown of a gaseous dielectric (e.g., the combustion-supporting oxygen atmosphere) is an integral part of the lamp ignition mechanism; (2) those having spaced apart electrodes, at least one of which is coated with a primer material, and relying on shreds of combustible metal foil in the lamp to provide a conducting path between the electrodes; e.g. see Albrecht U.S. Pat. No. 2,868,003; (3) those having a conductive primer bridge that electrically completes the circuit between the lead-in wires; such primers are rendered conductive by additives such as acetylene black, lead dioxide, or other electrical conduction-promoting agents; and (4) lamps having an essentially non-conducting primer bridge that connects the inner ends of the lead-in wires and which becomes conductive, upon application of a high voltage pulse, by means of breakdown of the dielectric binder separating conductive particles therein.

The earliest high voltage flashlamps were of the spark gap type construction wherein an electrical spark would pass through the gaseous atmosphere within the lamp. The spark would jump between two electrodes, at least one of which was coated with a primer composition. Such lamps tend to exhibit poor sensitivity and reliability when flashed from low power sources such as the miniaturized piezoelectric devices that are suited for incorporating into pocket-sized cameras. Most of the electrical input energy in such lamps is lost to the gap atmosphere by the spark. Also, the electrical characteristics vary considerably from one lamp to another because of shreds of metallic combustible in the spark gap and consequent variations in effective gap length.

In lamps of the second category, shreds of metal fill material are in contact with both the primer on one electrode and with the other electrode and form an electrically conducting path therebetween, such that, upon application of high voltage current to the electrodes, a spark discharge is formed through the primer material via the shreds and electrodes. In this manner, the above-noted disadvantages of the somewhat similar looking spark gap lamp are avoided.

The use of spaced lead-in wires interconnected by a quantity of electrically conductive primer gives rise to highly predictable behavior and a well-defined electrical path through the lamp. Here again, however, relatively highpowdered flash sources must be used in order to attain reliable lamp flashing.

Present state of the art flashlamps of the high voltage type make use of a bridge of initially nonconducting primer to interconnect the inner ends of the lead-in wires. Considerably higher sensitivity is attainable by this method, apparently because the breakdown and discharge follow a discrete path through the primer composition and thereby promote greater localized heating. With respect to specific construction, such flashlamps typically comprise a tubular glass envelope constricted and tipped off at one end and closed at the other end by a press seal. A pair of lead-in wires pass through the glass press and terminate in an ignition structure including a glass bead, one or more glass sleeves, or a glass reservoir of some type. A mass of primer material contained on the bead, sleeve or reservoir bridges across and contacts the ends of the lead-in wires. Also disposed within the lamp envelope is a quantity of filamentary metallic combustible, such as zirconium, or hafnium, and a combustion-supporting gas, such as oxygen, at an initial fill pressure of several atmospheres.

Lamp functioning is initiated by application of a high voltage pulse (e.g., several hundred to several thousand volts, as for example, from a piezoelectric crystal) across the lamp lead-in wires. The mass of primer within the lamp then breaks down electrically and ignites; its deflagration, in turn, ignites the shredded combustible which burns actinically.

The fabrication and testing of a number of different ignition structures has shown several problem areas that are peculiar to high voltage type flashlamps, and which are familiar to those skilled in the art of flashlamp design. For example, random location of the shreds of metallic combustible can cause short circuiting of the lead-in wires or interfere with the intended electrical breakdown path through the primer. Post-flash short circuiting can be caused by primer residue, metallic or semimetallic droplets of slag from the ignited shreds of combustible, and possible welding of the lead-in wires after ignition.

A further problem deals with the primer material itself. Previous primers for high voltage flashlamps have comprised a combination of at least three types of ingredients: (1) a combustible metal powder, such as zirconium (some applications have also included magnesium as a conduction-promoting agent); (2) an oxidizer salt, such as potassium chlorate or perchlorate; and (3) a binding agent such as nitrocellulose or polyvinyl alcohol. A fourth ingredient, called a sensitizer, may be used in addition to the first three. The sensitizers, may comprise either one or more of three distinct types taught; (a) fuels with very low ignition temperature, such as red phosphorus, sulfur, or selenium; (b) powdered semiconductors which modify the electrical conductivity of the primer bridge before or during electrical discharge therethrough, and represented by $PbO_2$, $MnO_2$, CuO, NiO, and $LaCoO_3$ doped with, e.g., Sr; and (c) organic nitrocompounds, such as tetrazene and lead styphnate.

High voltage primers of the above-described types comprising Zr powder (alone or with Mg powder), an oxidizer salt such as $KClO_4$, and a binder such as nitrocellulose, (either with or without "sensitizers") may be rendered quite sensitive toward ignition from low energy high voltage pulses. It is found that electrical input energy for reliable ignition is greatly dependent upon the amount of oxidizer salt present; as the relative amounts of, e.g., $KClO_4$ in the formulation increases, the required electrical triggering energy decreases. High loadings of such oxidizer salts (for example, 10–40% by weight of the dried primer) are thus favored.

Two real problems are inherent in all such high oxidizer salt primers, however. One is the hazardous nature of such mixtures to prepare and handle in production quantities. The other problem involves the quantity of smoke generated during deflagration of such mixtures. Studies have shown the smoke to comprise volatile chlorides of the alkali or alkaline earth metals used as the oxidizer salt. For example, when $KClO_4$ is decomposed to give up its oxygen content in a hot pyrotechnic mixture, KCl vapor is formed and is often the major component of the resulting white smoke.

The use of red phosphorus or sulfur as low-igniting sensitizers similarly has been found to cause formation of dense white smoke and deposits on the wall of the lamp vessel. In these cases, it is the $P_2O_5$ and $SO_3$ formed by burning of these elements in the oxygen rich atmosphere of the flashlamp.

Photometric tests have shown that any such smoke generation in a flashlamp as a result of primer deflagration seriously reduces the photographically useful light output from such a lamp.

Yet another problem associated with oxidizer salt primers has been encountered in arrays of high voltage flashlamps employing such primers. The lamps are intended to be selectively fired one at a time; however, undesired simultaneous firing of two or more lamps at a time has occurred, apparently due to leakage of the high voltage in the array structure and circuitry.

SUMMARY OF THE INVENTION

In view of the foregoing, it is an object of this invention to provide an improved photoflash lamp with a more reliable ignition means.

A particular object of the invention is to provide a primer for high voltage type photoflash lamps that is clean-burning, virtually smoke-free, and which permits attainment of high light output from such lamps.

Another object is to provide a primer for high voltage type photoflash lamps that is safer to manufacture.

Still another object of the invention is to provide a highly reliable construction for miniature tubular photoflash lamps of the high voltage type which eliminates the troublesome problems associated with short-circuiting both before and after flashing, permits automated and essentially failsafe dip application of primer thereto, and permits attainment of high functional reliability at low flash energies.

These and other objects, advantages and features are attained in accordance with the principles of this invention, by providing a primer material for high voltage type flashlamps which does not contain oxidizer salts but instead employs one or more metal oxides as the oxygen donor. Surprisingly, it has been found that certain of such thermite-type primer compositions, containing no oxidizer salts (and even without sensitizers), are highly sensitive toward high voltage discharge, and that they can be formulated so as to be nearly free of any smoke or volatile components. A very desirable accompanying benefit of such compositions is that, because they are nearly gas-free upon burning, they are nonexplosive and significantly safer to prepare and handle in an automated manufacturing operation. The sensitivity attained with the thermite-type compositions is quite unexpected to those skilled in the art, since such mixtures are often so insensitive as to require starting mixtures to effect ignition. Yet another advantage of such compositions is that the metal oxides have been observed to raise the breakdown voltage of the primer, whereby the undesired simultaneous flashing problem in lamp arrays is avoided.

The primer material bridges a pair of lead-in wires, one of which is enclosed in an insulating sleeve to preclude pre-ignition shorts. The lamp envelope contains an amount of combustion-supporting gas in excess of that needed to consume the filamentary combustible material so as to burn back the unsleeved lead-in wire during ignition and thereby preclude post-flash short circuits. Preferably, the initial fill gas pressure exceeds about four atmospheres. The primer composition is also useful in certain other types of high voltage ignition structures, in particular, the category (2) lamp type having spaced apart electrodes in contact with a shredded combustible fill material.

The high voltage primers according to the invention comprise a particulate fuel, one or more oxides of a metal having a boiling point above 2000° C, and a binding agent. The metal oxides should be substantially nonconductive electrically and have a lower free energy of formation than oxides of the fuel. Preferably, the fuel is a combustible metal powder including one or more of the following metals; zirconium, hafnium, aluminum and/or titanium. The mixture may also include some magnesium. The preferred metal oxides comprise the oxides of cobalt, tungsten, iron, manganese, nickel and/or copper. The high boiling points (above 2000° C) of all of the above mentioned metals, except for magnesium, render such mixtures nearly smokeless. Only the magnesium, of the ingredients present, gives rise to some visible smoke. This is tolerable, however, because the magnesium is present as a minor ingredient and also because it participates actively in ignition of the most sensitive mixtures.

With respect to prior art, U.S. Pat. No. 3,312,085, teaches that lead oxide ($PbO_2$) may be used together with potassium perchlorate ($KClO_4$) or alone as the sole oxidizer in primers for high voltage flash lamps. Primers using $PbO_2$ (which has a boiling point of about 1725° C) as the sole oxidizer have been tested under my supervision; upon deflagrating, such primers generate a dense yellow smoke of PbO, due to oxidation of the evolved Pb vapor in the oxygen atmosphere of the flashlamp. The resulting opacity of the atmosphere within the lamp, as well as the gross discoloration of the inner surface of the lamp envelope, render such $PbO_2$-rich mixtures unusable for, at least, modern miniature flashlamps with an internal volume of less than one cubic centimeter.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
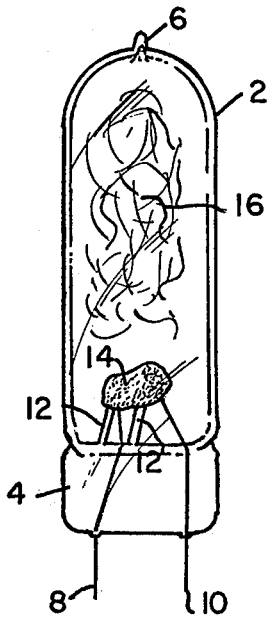
FIG. 1 is an elevational view of a photoflash lamp in accordance with the invention.
Figure 2:
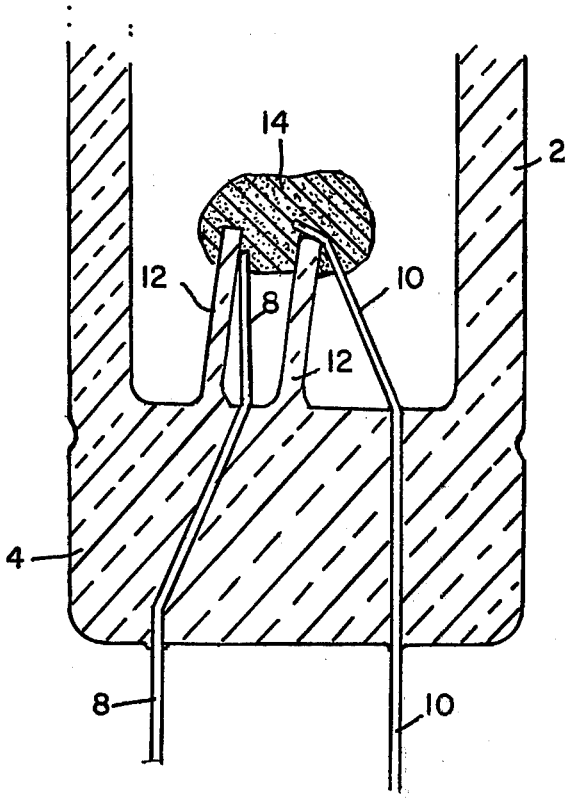
FIG. 2 is a fragmentary vertical sectional view on an enlarged scale of the inlead and ignition means construction of the lamp of FIG. 1.

Referring to FIGS. 1 and 2, the high-voltage type flashlamp illustrated therein comprises an hermetically sealed light-transmitting envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press, an insulating sleeve 12 extending within the envelope about lead-in wire 8, and a mass of primer material 14 bridging the ends of the lead-in wires within the envelope. The insulating sleeve 12 may be formed of glass or ceramic and is preferably sealed into the envelope press 4 at one end so that only the inward end of the sleeve is open. Lead-in wire 10 passes through press 4 and is formed so that it rests and terminates at or near the open end of the sleeve 12. The mass of primer material 14, which may be dip-applied, is disposed to substantially cover the open end of the sleeve 12 and bridge the ends of the lead-in wires, as best shown in FIG. 2.

Typically, the lamp envelope 2 has an internal diameter of less than one-half inch and an internal volume of less than 1 cc. A quantity of filamentary combustible fill material 16, such as shredded zirconium or hafnium foil, is dispupon flashing of the lamp, the combustible material 16 is completely consumed and the unsleeved lead-in wires 10 within the lamp is sufficiently burned back away from sleeve 12 so as to eliminate any chance of post-flash short circuiting. The length of the external surface of the sleeve 12 renders innocuous the effect of any shred droplets that adhere thereto.

The above-described lamp construction has some similarity to that described in U.S. Pat. No. 3,873,260 of Coté, except that Coté does not discuss excess oxygen or primer composition. Further, the Cote patent pointedly describes and claims the insulating sleeve as having a side vent opening (28), presumably for the purpose of avoiding air entrapment during primer application to assure the primer material reaches the sleeved lead. In contrast, sleeve 12 of the present construction has no venting provision, proper primer application into the sleeve being facilitated by the use of pressurized air during the primer dip operation.

The use of excess oxygen in a flashlamp to assure the burning back of inleads for providing an open circuit after flashing is described in copending application Ser. No. 508,959, filed Sept. 25, 1974 and assigned to the present assignee.

In accordance with the present invention, we have discovered quite unexpectedly, that a highly sensitive, clean-burning, and non-explosive primer for high-voltage type, miniature flashlamps can be provided by the use of a thermite-type composition that does not contain any oxidizer salts. Even more surprising, such results have been observed in the absence of sensitizers, such as semi-conductors or low-ignition temperature non-metallic elements other than the binders used. A reactive metal powder (the fuel) and one or more metal oxides are mixed with a binding agent such as nitrocellulose in a suitable solvent, for example amyl acetate. The resultant primer mixture is then applied, such as by a dip process, to form the ignition mass 14. When dried, the primer shows high ignition, sensitivity toward high voltage discharge across the ends of the lead-in wires.

Operation of such high voltage type flashlamps is initiated when a high voltage pulse from e.g., a piezoelectric crystal, is applied across the two lead-in wires 8 and 10. Electrical breakdown of the primer causes its deflagration which, in turn, ignites the shredded metallic combustible 16.

Advantages of the thermite-type primer described herein include: it exhibits high sensitivity and functional reliability for high-voltage type flashlamps; it is comparatively safe to manufacture and use in production quantities; it gives off little gas upon flashing and is, therefore, nonexplosive, thereby reducing the mechanical stress applied to a flashlamp envelope; it is clean-burning and does not give rise to smoke or discoloration of the flashlamp vessel; it gives good lamp performance reliability at low, practical input energies; and it increases the breakdown voltage of the primer as compared to oxidizer salt primers so as to preclude inadvertent simultaneous flashing of array lamps due to high voltage leakage paths in the interconnecting structure or circuitry.

The optimum powdered metal fuel from the standpoint of cost, availability, and performance is zirconium, which has a boiling point of 3580° C. It may be used alone, or together with other metal powders. The use of zirconium together with some magnesium may be desired so as to permit some degree of adjustment of the electrical voltage sensitivity of the primer. As previously noted, however, magnesium, with its relatively low boiling point of 1107° C, does give rise to some smoke. Hafnium, which has a boiling point of 5400° C, is somewhat less desirable than zirconium because of its high density which causes it to settle very rapidly from suspension. Titanium, which has a boiling point of 3260° C, may be used, but it is less sensitive than zirconium; the same is true of aluminum, which has a boiling point of 2450° C. A number of other metal powders are deemed functional for the oxidizer-free primers described herein, but because they are toxic, costly, rare, or unstable toward air, these metals are less desirable: thorium, uranium, lanthanum, yttrium, and the rare-earth metals.

As previously mentioned, the metal oxides employed as the sole oxygen donors in the mixture should be electrically nonconductive and be oxides of metals having a boiling point above 2000° C. Such metals include the following:

| Metal | Boiling Point (° C) |
|---|---|
| Cobalt | 2900 |
| Tungsten | 5927 |
| Iron | 3000 |
| Manganese | 2097 |
| Nickel | 2732 |
| Copper | 2595 |

The boiling point data set forth herein is taken from the Handbook of Chemistry and Physics 48th Edition, 1967–1968, Chemical Rubber Publishing Co. While the trioxides of cobalt, tungsten, and iron ($CO_2O_3$, $WO_3$, and $Fe_2O_3$) are preferred, it would be obvious to one skilled in the art in light of the inventive principles herein disclosed to substitute other oxides of these three metals. Among such alternative oxides are CoO, $Co_3O_4$, $WO_2$, $W_2O_5$, $W_4O_{11}$, FeO, and $Fe_3O_4$. The oxides of molybdenum, $MoO_3$, $MoO_2$, $Mo_2O_3$, and $Mo_2O_5$ are functional but lack the clean burning behavior shown by cobalt, tungsten, and iron oxides.

Other oxides studied in thermite-type, oxidizer salt-free primer formulations include NiO, CuO, $MnO_2$, $SnO_2$ and $PbO_2$. The oxides of nickel, copper and manganese appear satisfactory. Although manganese oxides are somewhat less sensitive, and nickel and copper oxides leave highly conductive residues after flashing and thus are limited by the electrical configuration of the ignition circuitry. The oxides of silver and tin are conductive and, therefore, not usable for this application. The dense yellow smoke caused by $PbO_2$ has already been referred to.

The binder used may be water- or solvent-soluble, and the choice of binding resin does not appear to be critical. For solvent type primers, nitrocellulose performs well. Other solvent-soluble resins may perform equally well should there be a reason to not use nitrocellulose. A water-soluble resin, hydroxyethyl cellulose, has given thermite-type primer performance essentially identical to that of similar nitrocellulose based primers. Again, many other water-soluble resins would be expected to work as well. The spirit of the inventive principle related herein is not associated with or restricted to the choice of particular resinous binders.

The thermite-type primer, on a dried basis, may contain from about 0.25 to 8% by weight of an organic resin such as nitrocellulose as a binder. I prefer to use between 1.5 to 3.0% of binding agent. Magnesium powder content may be from 0 to 30% by weight on a dried basis, although I prefer 8 to 12% of magnesium. At low magnesium contents, the sensitivity appears to fall off, while at higher percentages, the generation of white MgO smoke begins to become noticeable. The remaining percentage represents an essentially stoichiometric mixture of an active, hot burning metal powder (fuel) (such as zirconium, hafnium, aluminum, and/or titanium) and one or more metal oxides (from the group of metals cobalt, tungsten, iron, manganese, nickel and/or copper). The proportion of metal oxides can be from about 1% to 130% of the stoichiometric quantity required for chemical reaction with the combined powdered metal fuels in the mixture (e.g., Zr, Mg, etc.). That is, the amount of metal oxide used should fall within plus 30% or minus 99% of the calculated stoichiometric quantity required for thermite-type reaction with all of the metal powder used. Outside of this stoichiometric range, reliability falls off rapidly. I prefer to use an amount of metal oxides corresponding to a proportion of from about 30 to 100% of the stoichiometric quantity required for chemical reaction with the powdered metal fuel in the mixture.

The primers disclosed herein may be used with, and will offer desirable performance for, lamps of the high voltage type other than the specific construction described herein. Any flashlamp that operates by means of passing an electrical pulse through a quantity of primer could, in principle, make use of the primers related herein. This includes the category (2) type lamps which do not employ a primer bridge but rather have spaced electrodes, with primer on at least one of the electrodes, and rely on combustible metal shreds filling the lamp to provide a conducting path between the electrodes. Thus, whereas in the above-described primer bridge lamps and in some variations of the category (2) lamps, the primer material covers portions of both lead-in wires, the present invention is also applicable in lamps in which the mass of primer material covers a portion of at least one of the lead-in wires within the lamp envelope.

The use of magnesium powder as an additive to lower the electrical breakdown voltage has already been alluded to. Also sensitizers (e.g., semiconductors, lead styphnate, red phosphorus, etc.) can, of course, be incorporated into the salt-free primer disclosed herein, and may afford their known benefits if so desired.

By way of example only, a primer embodying the inventive principles described herein was prepared using 41.0% zirconium powder, 7.4% magnesium powder, 49.7% cobaltic oxide, and 1.9% type RS nitrocellulose on a dried basis. The nitrocellulose was dissolved in sufficient amyl acetate so as to give a final primer slurry of about 65% by weight solids. A group of sixteen lamps of the construction shown in FIGS. 1 and 2 were prepared. The lamps were fabricated from type 7052 glass tubing of 0.259 inch O.D. The internal volume was 0.32 $cm^3$; the quantity of filamentary combustible material 16 was 14.0 mgs. of 4 inch-long zirconium shreds having a cross section of 0.00093 × 0.0012 inch; the oxygen fill pressure was 950 cm. Hg. absolute. The lead-in wires 8 and 10 were 0.014 inch diameter Rodar; the insulating sleeve 12 was 0.160 inch long, type 7052 glass having an O.D. of 0.060 inch and an I.D. of 0.030 inch. Approximately 2 mgs. of primer 14 were used for each lamp. The lamps were flashed from a piezoelectric source having a 125 microjoule, 2000 volt output pulse. All lamps flashed reliably, and the ignition was virtually smoke-free.

Although the invention has been described with respect to a specific embodiment, it will be appreciated that modifications and changes may be made by those skilled in the art without departing from the true spirit and scope of the invention.

What I claim is:

1. A photoflash lamp comprising:

an hermetically sealed, light-transmitting envelope;

a quantity of filamentary combustible material located within said envelope;

a combustion-supporting gas in said envelope at an initial fill pressure exceeding one atmosphere;

and a non-filament type ignition means disposed in said envelope in operative relationship with respect to said combustible fill material and adapted to be ignited by a high voltage pulse, said ignition means including a pair of lead-in wires extending into said envelope in a spaced relationship, and a mass of primer material covering a portion of at least one of said lead-in wires within said envelope, said primer material comprising a particulate fuel, one or more oxides of metals having a boiling point substantially above 2097° C, said metal oxides being substantially nonconductive electrically and having a lower free energy of formation than the oxides of said fuels, and a binding agent, said primer material being free of oxidizer salts.

2. The lamp of claim 1 wherein said combustion-supporting gas in said envelope is oxygen.

3. The lamp of claim 1 wherein said fuel is a combustible metal powder.

4. The lamp of claim 3 wherein said primer material comprises a mixture in which the proportion of said binding agent is from about 0.25 to 8% by weight on a dried basis, and the proportion of said metal oxides is from about 1% to 130% of the stoichiometric quantity required for chemical reaction with said powdered metal fuel in said mixture.

5. The lamp of claim 4 wherein said powdered metal fuel includes magnesium, the proportion of magnesium powder in said primer mixture being from about 0 to 30% by weight on a dried basis.

6. The lamp of claim 3 wherein said primer material consists essentially of a mixture in which the proportion of said binding agent is from about 1.5 to 3.0% by weight on a dried basis, and the proportion of said metal oxides is from about 30 to 100% of the stoichiometric quantity required for chemical reaction with said powdered metal fuel in said mixture.

7. The lamp of claim 6 wherein said powdered metal fuel includes magnesium, the proportion of magnesium powder in said mixture being from about 8 to 12% by weight on a dried basis.

8. The lamp of claim 3 wherein said combustible metal powder includes zirconium, hafnium, aluminum, titanium and/or magnesium.

9. The lamp of claim 8 wherein said one or more metal oxides comprise the oxides of cobalt, tungsten, iron, nickel and/or copper.

10. The lamp of claim 1 further including a sleeve of insulating material extending within said envelope about one of said lead-in wires, said sleeve being sealed to said envelope at one end and open at the other end, the other of said lead-in wires terminating at or near the open end of said sleeve, and said mass of primer material being disposed to substantially cover the open end of said sleeve and bridge the ends of said lead-in wires.

11. The lamp of claim 10 wherein said combustion-supporting gas in said envelope is in an amount in excess of the quantity required for stoichiometric chemical reaction with said filamentary combustible material whereby, upon flashing of the lamp, said filamentary combutible material is consumed and the unsleeved lead-in wire is sufficiently burned back to prevent post-flash short circuiting of the lamp.

12. The lamp of claim 11 wherein fuel is a combustible metal powder.

* * * * *